US005858209A

United States Patent [19]

Schmidt et al.

[11] Patent Number: 5,858,209

[45] **Date of Patent: *Jan. 12, 1999**

[54] CATALYTIC REFORMING PROCESS WITH INCREASED AROMATICS YIELD

[75] Inventors: Robert J. Schmidt, Barrington; John J. Jeanneret, Western Springs, both of Ill.; Srikantiah Raghuram, New Delhi, India; Beth McCulloch, Clarendon, Hills, Ill.

[73] Assignee: UOP, Des Plaines, Ill.

[ * ] Notice: The term of this patent shall not extend beyond the expiration date of Pat. No. 5,672,265.

[21] Appl. No.: 940,821

[22] Filed: Sep. 30, 1997

Related U.S. Application Data

[63] Continuation-in-part of Ser. No. 288,707, Aug. 15, 1994, Pat. No. 5,672,265.

[51] Int. Cl.[6] ..... C10G 45/00; C10G 45/10

[52] U.S. Cl. ..... 208/142; 208/62; 208/66

[58] Field of Search ..... 208/142, 62, 66

[56] References Cited

U.S. PATENT DOCUMENTS

| | | | |
|---|---|---|---|
| 2,853,437 | 9/1958 | Haensel | 196/50 |
| 2,915,453 | 12/1959 | Haensel et al. | 208/64 |
| 3,001,928 | 9/1961 | Grote | 208/65 |
| 3,706,813 | 12/1972 | Neuzil | 260/676 MS |
| 4,648,961 | 3/1987 | Jacobson et al. | 208/138 |
| 5,107,052 | 4/1992 | McColloch | 585/738 |
| 5,672,265 | 9/1997 | Schmidt | 208/142 |

*Primary Examiner*—Helane Myers

*Attorney, Agent, or Firm*—Thomas K. McBride; John F. Spears, Jr.; Richard E. Conser

[57] ABSTRACT

A processing step is added to an existing catalytic reforming unit to increase the yield of aromatic product. The additional processing comprises separation of product from the reforming unit into an aromatic concentrate and a low-octane recycle stream which is upgraded by aromatization. The separation preferably is effected using a large-pore molecular sieve, and the aromatization with a nonacidic L-zeolite contained within the hydrogen circuit of the existing catalytic reforming unit.

20 Claims, 2 Drawing Sheets

CATALYTIC REFORMING PROCESS WITH INCREASED AROMATICS YIELD

CROSS REFERENCE TO RELATED APPLICATION

This application is a continuation-in-part of prior application Ser. No. 08/288,707, filed Aug. 15, 1994 now U.S. Pat. No. 5,672,265, the contents of which are incorporated herein by reference thereto.

BACKGROUND OF THE INVENTION

1. Field of the Invention

This invention relates to an improved process for the conversion of hydrocarbons, and more specifically for the catalytic reforming of gasoline-range hydrocarbons.

2. General Background

The catalytic reforming of hydrocarbon feedstocks in the gasoline range is an important commercial process, practiced in nearly every significant petroleum refinery in the world to produce aromatic intermediates for the petrochemical industry or gasoline components with high resistance to engine knock. The widespread removal of lead antiknock additive from gasoline and the rising demands of high-performance internal-combustion engines, increasing the required knock resistance of gasoline components as measured by gasoline "octane" number, have been a major factor in the growth of catalytic-reforming capacity and continue this trend in many areas of the world. The market for petrochemicals derived from gasoline-range aromatics continues to grow substantially, creating a need for incremental reforming capacity, severity and/or efficiency. Many producers of aromatics are looking for ways to use or upgrade existing reforming capacity through more effective reforming processes and catalysts in order to meet this incremental need without building expensive new catalytic-reforming process units.

Catalytic reforming generally is applied to a feedstock rich in paraffinic and naphthenic hydrocarbons and is effected through diverse reactions: dehydrogenation of naphthenes to aromatics, dehydrocyclization of paraffins, isomerization of paraffins and naphthenes, dealkylation of alkylaromatics, hydrocracking of paraffins to light hydrocarbons, and formation of coke which is deposited on the catalyst. Increased aromatics and gasoline-octane needs have turned attention to the paraffin-dehydrocyclization reaction, which is less favored thermodynamically and kinetically in conventional reforming than other aromatization reactions. Considerable leverage exists for increasing desired product yields from catalytic reforming by promoting the dehydrocyclization reaction over the competing hydrocracking reaction while minimizing the formation of coke.

The effectiveness of reforming catalysts comprising a non-acidic L-zeolite and a platinum-group metal for dehydrocyclization of paraffins is well known in the art. The experimental use of these reforming catalysts to produce aromatics from paraffinic raffinates as well as naphthas has been disclosed by a number of companies active in technology development. Commercialization of this dehydrocyclization technology nevertheless has been slow, probably due at least in part to the reluctance of aromatics producers to spend large sums of money on entirely new processing units in order to expand capacity. The present invention represents a novel approach to the use of this technology in the context of an existing catalytic-reforming process unit.

Separation and recycle of a paraffinic fraction to reforming is disclosed in U.S. Pat. No. 2,853,437 (Haensel). Naphtha is split into low-boiling and a high-boiling fractions, with the low-boiling naphtha being combined with a high-boiling paraffinic recycle and the high-boiling naphtha combined with low-boiling paraffinic recycle. Each combined stream preferably is charged alternately to catalytic reforming, and the reformate is solvent-extracted to separate a paraffinic fraction; the paraffinic fraction is fractionated to obtain the low-boiling and high-boiling paraffinic recycle to reforming. U.S. Pat. No. 2,915,453 (Haensel et al.) teaches reforming of naphtha and heavy paraffinic raffinate, separating a raffinate from the reformate by solvent extraction, and fractionating the raffinate to recover a low-boiling paraffinic fraction which is sent to a separate reforming zone.

U.S. Pat. No. 3,001,928 (Grote) discloses reforming of a gasoline fraction, subjecting the heavier reformate product to solvent extraction to recover a non-aromatic raffinate, and reforming the raffinate. The raffinate is reformed at a pressure at least 75 pounds per square inch lower than that at which the gasoline fraction is reformed.

Selective adsorption of multibranched paraffins from a feed mixture also containing singly-branched and/or normal paraffins using a crystalline aluminosilicate is disclosed in U.S. Pat. No. 3,706,813. The zeolite must contain a certain percentage of water, and preferably is X or Y zeolite modified with barium cations. U.S. Pat. No. 5,107,052 teaches the adsorptive separation of dimethylparaffins from an isomerate comprising $C_4$, $C_5$ and $C_6$ hydrocarbons using a zeolite or aluminophosphate isostructural with $AlPO_4$-5.

U.S. Pat. No. 4,648,961 (Jacobson et al.) discloses dehydrocyclization of a naphtha feedstock with a monofunctional large-pore zeolite catalyst, separating normal and single-branched paraffins from the aromatics product, and recycling the paraffins to the dehydrocyclization step. The paraffins are extracted for recycle using a molecular sieve, which adsorbs normal paraffins and some of the isoparaffins.

SUMMARY OF THE INVENTION

It is an object of the present invention to provide a catalytic reforming process which effects an improved product yield structure. A corollary objective is to utilize a large-pore zeolite to effect improved aromatics yields in an existing catalytic reforming process unit.

This invention is based on the discovery that addition of reformate paraffin separation and aromatization utilizing a catalyst containing an L-zeolite to a catalytic reforming process shows surprising improvements in aromatics yields relative to the prior art.

A broad embodiment of the present invention is a process combination in which a hydrocarbon feedstock is upgraded in a catalytic reforming unit to obtain a reformate, which subsequently is separated into an aromatic product and a paraffin recycle to aromatization yielding an aromatics-enriched stream which also is subjected to separation into an aromatic product and paraffin recycle to aromatization. The reformate separation and paraffin aromatization advantageously are added to an existing catalytic reforming unit, utilizing the existing reforming-unit hydrogen circuit with resulting cost savings.

Preferably the separation is effected using a sieve adsorbent which provides a paraffin recycle concentrated in low-octane normal and singly branched paraffins. An adsorbent which adsorbs aromatics and multiply branched paraffins from the reformate is especially preferred, with the recycle paraffins being recovered as raffinate.

Aromatization preferably is effected using a catalyst containing nonacidic L-zeolite, most preferably potassium-form L-zeolite. The aromatization catalyst contains a platinum-group metal, preferably platinum along with an alkali metal and an inorganic-oxide binder.

These as well as other objects and embodiments will become apparent from the detailed description of the invention.

DESCRIPTION OF THE PREFERRED EMBODIMENTS

Figure 1:
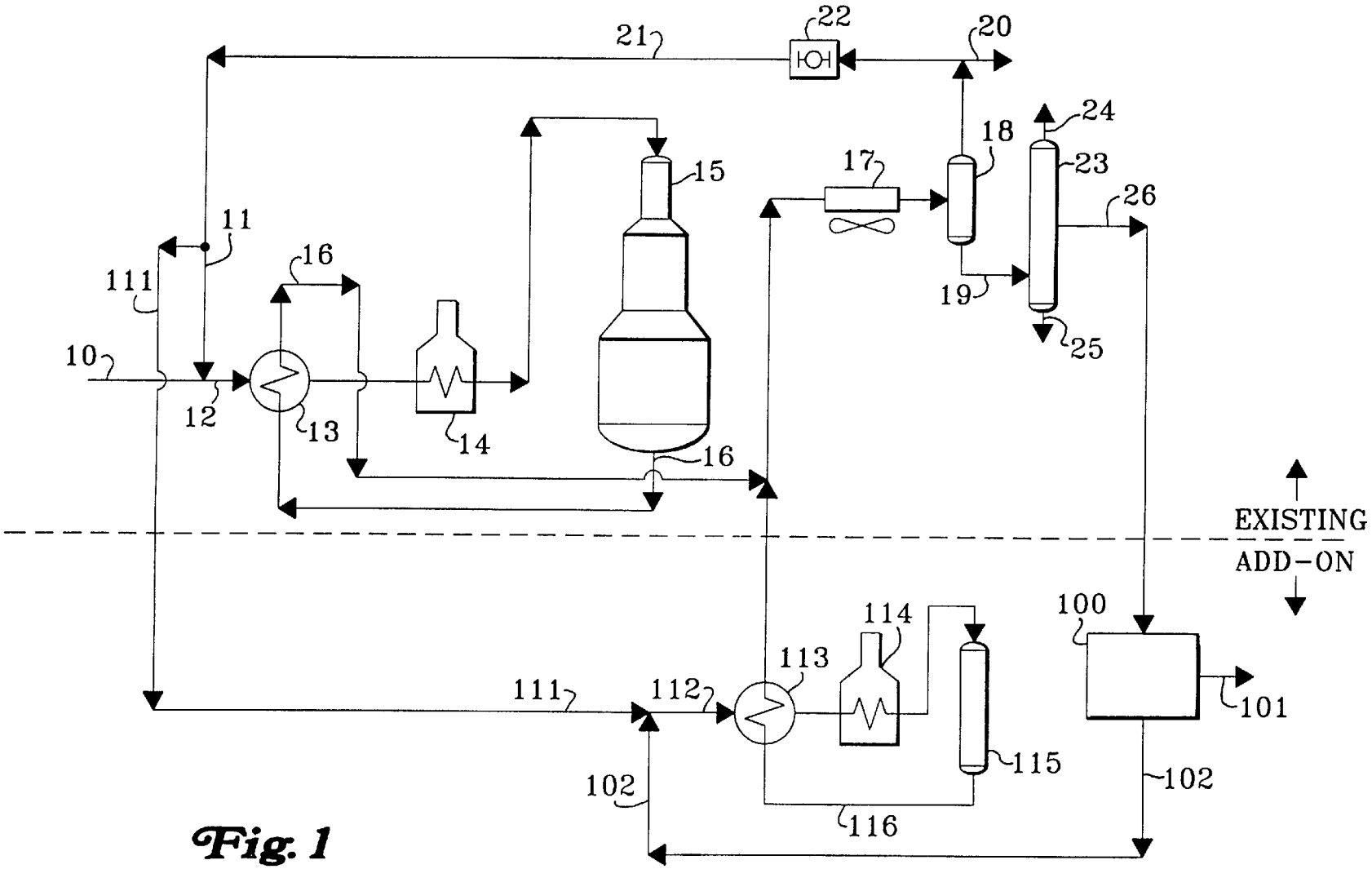
FIG. 1 shows the preferred arrangement of the major process equipment of the invention.

The process of the present invention broadly comprises a catalytic reforming unit which upgrades a hydrocarbon feedstock to obtain a reformate which is separated into an aromatic product and a paraffin recycle to an aromatization zone. Preferably the separation is effected using a sieve adsorbent which separates an aromatic product stream from a paraffin recycle concentrated in low-octane normal and singly branched paraffins. Aromatization optimally is effected using a catalyst containing nonacidic L-zeolite, yielding an aromatics-enriched stream which further is subjected to separation into an aromatic product and paraffin recycle to aromatization. The reformate separation and paraffin aromatization comprise an add-on process to the catalytic reforming unit.

The catalytic reforming unit favorably is an existing unit, i.e., the unit comprises processing equipment that cannot readily be expanded in size or capacity to accommodate increased throughput. The equipment includes reactors, reactor internals for distributing feed and containing catalyst, other vessels, heaters, heat exchangers, conduits, valves, pumps, compressors and associated components known to those of ordinary skill in the art. Such an existing unit may previously have been in operation to effect catalytic reforming of the feedstock defined herein or to effect conversion of hydrocarbons with another objective such as, but not limited to, isomerization, hydrotreating, hydrocracking, alkylation, dealkylation, transalkylation or disproportionation; alternatively, the processing equipment may have been purchased or fabricated but not yet used in reforming or other conversion. In any event, such an existing unit requires an add-on process as defined herein in order to effect the present invention.

The hydrocarbon feedstock to the present process comprises paraffins and naphthenes, and may comprise aromatics and small amounts of olefins, boiling within the gasoline range. Feedstocks which may be utilized include straight-run naphthas, natural gasoline, synthetic naphthas, thermal gasoline, catalytically cracked gasoline, partially reformed naphthas or raffinates from extraction of aromatics. The distillation range may be that of a full-range naphtha, having an initial boiling point typically from 40°–80° C. and a final boiling point of from about 160°–210° C., or it may represent a narrower range with a lower final boiling point of as low as about 110° or even 85° C. Usually the feedstock includes hexanes, which are effectively converted to benzene according to the present invention, but not substantial amounts of pentanes; thus, the initial boiling point preferably is at least 60° C. Paraffinic feedstocks, such as naphthas from Middle East crudes, are advantageously processed since the process effectively dehydrocyclizes paraffins to aromatics. Raffinates from aromatics extraction, containing principally low-value $C_6$–$C_8$ paraffins which can be converted to valuable B-T-X aromatics, are favorable alternative hydrocarbon feedstocks.

Hydrocarbons within the above ranges as distilled from petroleum stocks generally contain small amounts of sulfur compounds, amounting to generally less than 1000 mass parts per million (ppm) on an elemental basis. Preferably the hydrocarbon feedstock to the present process has been prepared from such contaminated stocks by a conventional pretreating step such as hydrotreating, hydrorefining or hydrodesulfurization to convert such contaminants as sulfurous, nitrogenous and oxygenated compounds to $H_2S$, $NH_3$ and $H_2O$, respectively, which can be separated from the hydrocarbons by fractionation. This conversion preferably will employ a catalyst known to the art comprising an inorganic oxide support and metals selected from Groups VIB(IUPAC 6) and VIII(IUPAC 9-10) of the Periodic Table. [See Cotton and Wilkinson, *Advanced Organic Chemistry,* John Wiley & Sons (Fifth Edition, 1988) for IUPAC notation]. Alternatively or in addition to the conventional hydrotreating, the pretreating step may comprise contact with sorbents capable of removing sulfurous and other contaminants. These sorbents may include but are not limited to zinc oxide, iron sponge, high-surface-area sodium, high-surface-area alumina, activated carbons and molecular sieves; excellent results are obtained with a reduced nickel-on-alumina sorbent. Preferably, the pretreating step will provide the first reforming catalyst with a hydrocarbon feedstock having low sulfur levels disclosed in the prior art as desirable reforming feedstocks, e.g., 1 ppm to 0.1 ppm (100 ppb).

The pretreating step may achieve very low sulfur levels in the hydrocarbon feedstock by combining a relatively sulfur-tolerant reforming catalyst with a sulfur sorbent. The sulfur-tolerant reforming catalyst contacts the contaminated feedstock to convert most of the sulfur compounds to yield an $H_2S$-containing effluent. The $H_2S$-containing effluent contacts the sulfur sorbent, which advantageously is a zinc oxide or manganese oxide, to remove $H_2S$. Sulfur levels well below 0.1 mass ppm may be achieved thereby. It is within the ambit of the present invention that the pretreating step be included in the present reforming process.

The catalytic reforming unit comprises either a fixed-bed reactor or a moving-bed reactor whereby catalyst may be continuously withdrawn and added. These alternatives are associated with catalyst-regeneration options known to those of ordinary skill in the art, such as: (1) a semiregenerative unit containing fixed-bed reactors, which maintains operating severity by increasing temperature, eventually shutting the unit down for catalyst regeneration and reactivation; (2) a swing-reactor unit, in which individual fixed-bed reactors are serially isolated by manifolding arrangements as the catalyst becomes deactivated and the catalyst in the isolated reactor is regenerated and reactivated while the other reactors remain on-stream; (3) continuous regeneration of catalyst withdrawn from a moving-bed reactor, with reactivation and substitution of the reactivated catalyst, which permits higher operating severity by maintaining high catalyst activity through regeneration cycles of a few days; or, (4) a hybrid system with semiregenerative and continuous-regeneration provisions in the same unit. The feedstock may contact the catalyst in the catalytic reforming unit may contact the catalyst in the reactors in either upflow, downflow, or radial-flow mode. The add-on process of the invention is suitable for a catalytic reforming unit operating in any of the above modes.

The hydrocarbon feedstock contacts the reforming catalyst in the catalytic reforming unit to effect a variety of reactions including dehydrogenation of naphthenes, isomerization, cracking and dehydrocyclization of aliphatics. Reforming conditions comprise a pressure of from about 100 kPa to 6 MPa (absolute) and preferably from about 100 kPa to 2 MPa (absolute); because low pressures are favored for the add-on aromatization zone, operating pressures of less than 1 MPa are especially preferred. Free hydrogen suitably is present in a molar ratio to the hydrocarbon feedstock of from about 0.1 to 10. Space velocity with respect to the volume of reforming catalyst is from about 0.2 to 20 $hr^{-1}$. Operating temperature is from about 260° to 560° C. and preferably from about 400° to 560° C.

The catalyst utilized in the catalytic reforming unit may be a dual-function composite containing a metallic hydrogenation-dehydrogenation component on a refractory support which provides acid sites for cyclization, cracking and isomerization. Preferably, for compatibility with the catalyst in the aromatization zone of the add-on process, the reforming catalyst is a nonacidic molecular-sieve catalyst selective for dehydrocyclization.

The refractory support of a dual-function reforming catalyst should be a porous, adsorptive, high-surface-area material which is uniform in composition without composition gradients of the species inherent to its composition. Within the scope of the present invention are refractory support containing one or more of: (1) refractory inorganic oxides such as alumina, silica, titania, magnesia, zirconia, chromia, thoria, boria or mixtures thereof; (2) synthetically prepared or naturally occurring clays and silicates, which may be acid-treated; (3) crystalline zeolitic aluminosilicates, either naturally occurring or synthetically prepared such as FAU, LTL, MAZ, MEL, MFI, MOR, MTW (IUPAC Commission on Zeolite Nomenclature), in hydrogen form or in a form which has been exchanged with metal cations; (4) spinels such as $MgAl_2O_4$, $FeAl_2O_4$, $ZnAl_2O_4$, $CaAl_2O_4$; (5) non-zeolitic molecular sieves as disclosed in U.S. Pat. No. 4,741,820 which is incorporated by reference; and (6) combinations of materials from one or more of these groups. The preferred refractory support for the reforming catalyst is alumina, with gamma- or eta-alumina being particularly preferred. Best results are obtained with "Ziegler alumina," described in U.S. Pat. No. 2,892,858 and presently available from the Vista Chemical Company under the trademark "Catapal" or from Condea Chemie GmbH under the trademark "Pural." Ziegler alumina is an extremely high-purity pseudoboehmite which, after calcination at a high temperature, has been shown to yield a high-porosity gamma-alumina. It is especially preferred that the refractory inorganic oxide comprise substantially pure Ziegler alumina having an apparent bulk density of about 0.6 to 1 g/cc and a surface area of about 150 to 280 $m^2/g$ (especially 185 to 235 $m^2/g$) at a pore volume of 0.3 to 0.8 cc/g.

The alumina powder may be formed into any shape or form of carrier material known to those skilled in the art such as spheres, extrudates, rods, pills, pellets, tablets or granules. Spherical particles may be formed by converting the alumina powder into alumina sol by reaction with suitable peptizing acid and water and dropping a mixture of the resulting sol and gelling agent into an oil bath to form spherical particles of an alumina gel, followed by known aging, drying and calcination steps. The preferred extrudate form is preferably prepared by mixing the alumina powder with water and suitable peptizing agents, such as nitric acid, acetic acid, aluminum nitrate and like materials, to form an extrudable dough having a loss on ignition (LOI) at 500° C. of about 45 to 65 mass %. The resulting dough is extruded through a suitably shaped and sized die to form extrudate particles, which are dried and calcined by known methods. Alternatively, spherical particles can be formed from the extrudates by rolling the extrudate particles on a spinning disk.

The preferred reforming catalyst comprises a non-acidic zeolitic aluminosilicate, optimally a non-acidic L-zeolite which has substantially all of its cationic exchange sites occupied by nonhydrogen species. Preferably the cations occupying the exchangeable cation sites will comprise one or more of the alkali metals, with potassium-form L-zeolite being especially preferred. Usually the L-zeolite is composited with a binder in order to provide a convenient form for use in the catalyst of the present invention, with one or more of silica, alumina or magnesia being preferred binder materials and amorphous silica being especially preferred. The zeolite and binder may be composited to form the desired catalyst shape by any method known in the art, with an extrudate being favored and spherical particles being a useful alternative. An additional alkali-metal component usually is present, for example a surface-deposited alkali metal as described in U.S. Pat. No. 4,619,906. Further details of the preferred non-acidic zeolitic reforming catalyst are as described hereinbelow for the aromatization catalyst.

A catalytically effective amount of a platinum-group metal component is an essential feature of the reforming catalyst, with a platinum component being preferred. The platinum-group metal component may be incorporated in the catalyst in any suitable manner such as but not limited to coprecipitation, ion exchange or impregnation with a soluble, decomposable compound of the metal. The platinum-group metal may exist within the catalyst as a compound such as the oxide, sulfide, halide, or oxyhalide, in chemical combination with one or more other ingredients of the catalytic composite, or as an elemental metal. Best results are obtained when substantially all of the metal exists in the catalytic composite in a reduced state. The preferred platinum component generally comprises from about 0.01 to 5 mass % of the catalytic composite, preferably 0.05 to 2 mass %, calculated on an elemental basis.

It is within the scope of the present invention that the reforming catalyst contains a metal promoter to modify the effect of the preferred platinum component. Such metal modifiers may include Group IVA (IUPAC 14) metals, other Group VIII (IUPAC 8-10) metals, rhenium, indium, gallium, zinc, uranium, dysprosium, thallium and mixtures thereof. Excellent results are obtained when the reforming catalyst contains a tin component. Catalytically effective amounts, between 0.01 and 5 mass % on an elemental basis, of such metal modifiers may be incorporated into the catalyst by any means known in the art.

A dual-function reforming catalyst may contain a halogen component. The halogen component may be either fluorine, chlorine, bromine or iodine or mixtures thereof with chlorine being preferred. The optional halogen component is generally present in a combined state with the inorganic-oxide support. The halogen component is preferably well dispersed throughout the catalyst and, if present, may comprise from more than 0.2 to about 15 wt. %. calculated on an elemental basis, of the final catalyst.

The reforming catalyst generally will be dried at a temperature of from about 100° to 320° C. for about 0.5 to 24 hours, followed by oxidation at a temperature of about 300° to 550° C. in an air atmosphere for 0.5 to 10 hours. Preferably the oxidized catalyst is subjected to a substantially waterfree reduction step at a temperature of about 300° to 550° C. for 0.5 to 10 hours or more. Further details of the preparation and activation of embodiments of the reforming catalyst are disclosed in U.S. Pat. No. 4,677,094 (Moser et al.), which is incorporated into this specification by reference thereto.

Using techniques and equipment known in the art, a reformed effluent from the reforming zone usually is passed through a cooling zone to a separation zone. In the separation zone, typically maintained at about 0° to 65° C., a hydrogen-rich gas is separated from a liquid phase. Most of the resultant hydrogen-rich stream optimally is recycled through suitable compressing means back to the aromatization zone, with a portion of the hydrogen being available as a net product for use in other sections of a petroleum refinery or chemical plant. The liquid phase from the separation zone is normally withdrawn and processed in a fractionating system in order to adjust the concentration of light hydrocarbons and to produce an aromatics-containing reformate product.

The add-on process comprises the addition of a separation zone and an aromatization zone to the catalytic reforming unit described above. A preferred configuration of the major equipment is shown in FIG. 1. The hydrocarbon feedstock 10 is combined with recycle hydrogen 11, and the combined feed 12 is heated to reforming temperature in a combined-feed exchanger 13 and heater 14. The heated combined feed is charged to the catalytic-reforming reactors 15 comprising two or more reactors with suitable interheating to compensate for the endothermic heat of reaction. Reactor effluent 16 exchanges heat with reformer feed in exchanger 13, is cooled in cooler 17 and passes to separator 18 from which net hydrogen 20 and recycle hydrogen 21 are taken. The recycle hydrogen 21 is compressed in compressor 22, with a portion 11 being returned to the combined feed as discussed above and a slipstream 111 passing to the add-on process of the invention as described below. Preferably the reforming unit comprising the equipment 13–21 is an existing unit which desirably is modified according to the present invention. The hydrogen circuit comprising separator 18 and compressor 22 desirably is maintained without substantial modification in the present invention.

Liquid 19 from the separator 18 is directed to fractionation 23, which removes light ends 24 and may separate a heavy fraction 25 from the reformate. According to the invention, reformate 26 passes to a new separation zone 100. An concentrate of aromatic hydrocarbons is separated as an aromatic product stream 101 from a recycle stream 102 which comprises normal and singly branched paraffins having a low octane number as a gasoline component. The paraffin recycle joins a slipstream of hydrogen 111 from the reformer hydrogen circuit described hereinabove, and the resulting combined recycle to the aromatization zone 112 passes through a combined recycle exchanger 113 and heater 114 to the aromatization reactors 115; these reactors may be in parallel for catalyst change or regeneration or in series with intermediate heating. Conversion of paraffins to aromatics is effected in the aromatization reactors, and reactor effluent 116 is cooled in the recycle exchanger 113 and sent to the cooler 17 and separator 18 of the reforming operation. An aromatics-enriched stream produced in the aromatization zone therefore is processed through fractionation and the separation zone to obtain an additional aromatic product stream and paraffinic recycle.

The separation zone preferably comprises adsorptive separation, but alternatively may comprise either solvent extraction or a combination of solvent extraction and adsorptive separation in sequence to separate the reformate into a low-octane paraffin fraction and an aromatic-rich fraction. Solvent extraction separates essentially all of the paraffins, as well as the relatively smaller amounts of olefins and naphthenes, from an aromatic concentrate. Adsorptive separation selectively separates normal paraffins and, optionally, low-branched paraffins from other hydrocarbons. By low-branched paraffins are meant those with few carbon side chains, and especially those with only one methyl side chain. Solvent extraction thus produces a more concentrated aromatics stream, considering that essentially all of the paraffins are removed, while adsorptive separation produces a lower-octane paraffin fraction considering the following comparative RONs (Research octane numbers) of heptanes, as the usual reformate paraffins would comprise, according to API Research Project 44:

| | |
|---|---|
| Normal heptane | 0 |
| Methyl hexanes | 42–65 |
| Dimethyl pentanes | 80–92 |

Since normal and singly branched paraffins generally constitute the preponderance of the paraffins in the reformate, the entire paraffin fraction can be justifiably recycled to obtain high overall aromatics yields. Preferably, however, the low-octane paraffins are separated by adsorption while leaving the relatively higher-octane paraffins in the aromatic concentrate or producing them as a separate stream for gasoline blending.

Solvent extraction suitably comprises contacting the reformate in an extraction zone with an aromatic-extraction solvent which selectively extracts aromatic hydrocarbons. The aromatic hydrocarbons generally are recovered as extract from the solvent phase by one or more distillation steps, and the raffinate from extraction typically is purified by water washing. Solvent extraction normally will recover from about 90 to 100% of the aromatics from the reformate into the extract and reject from about 95 to 100% of the paraffins from the reformate into the raffinate. Solvent compositions are selected from the classes which have high selectivity for aromatic hydrocarbons and are known to those of ordinary skill in the hydrocarbon-processing art. These generally comprise one or more organic compounds containing in their molecule at least one polar group, such as a hydroxyl-, amino-, cyano-, carboxyl-, or nitro-radical, preferably selected from the aliphatic and cyclic alcohols, cyclic monomeric sulfones, glycols and glycol ethers, glycol esters and glycol ether esters.

Solvent-extraction conditions are generally well known to those trained in the art and vary depending on the particular aromatic-selective solvent utilized. Conventional conditions include an elevated temperature and a sufficiently elevated pressure to maintain solvent reflux and the reformate feed in the liquid phase. When using a solvent such as sulfolane, suitable temperatures are about 25° to 200° C., preferably about 80° to 150° C., and suitable pressures are about atmospheric to 30 atmospheres gauge (100 kPa to 3 MPa) and preferably about 3 to 10 atmospheres (300 kPa to 1 MPa). Solvent quantities should be sufficient to dissolve substantially all of the aromatic hydrocarbons present in the reformate feed, and solvent-to-feed ratios by volume of about 2:1 to 10:1 are preferred. Further details of solvent extraction as applied to reformate upgrading are as indicated in U.S. Pat. No. 5,294,328, incorporated herein by reference.

When employing a combination of solvent extraction and adsorptive separation in sequence, the solvent extraction yields a paraffin fraction which is further separated by adsorption into the recycle stream comprising normal and singly branched paraffins and a stream of relatively higher-octane paraffins preferably for gasoline blending.

When employing the preferred adsorptive separation step to directly process reformate, normal paraffins and optionally low-branched paraffins are selectively separated from other hydrocarbons. The aromatic-rich fraction thus contains naphthenes and branched paraffins, particularly such as dimethyl, trimethyl and ethyl alkanes, in lower concentrations relative to the aromatics content.

Adsorptive separation processes useful in the present invention may be classified by the range of paraffins adsorbed. One type of process separates normal paraffins from all other hydrocarbons, including both branched paraffins and cyclic hydrocarbons. This process generally uses an adsorbent known as 5 A or calcium zeolite A to selectively adsorb the normal paraffins from the reformate feed stream. Aspects of this process are described, inter alia, in U.S. Pat. Nos. 4,036,745 and 4,210,771, incorporated herein by reference thereto. Normal paraffins have the lowest octane numbers of any hydrocarbon in any given carbon-number range, so the removal by adsorption of normal paraffins from a stream provides a substantial increase in octane number of the aromatic-rich adsorption raffinate as a gasoline-blending component.

Another type of adsorption process separates low-branched paraffins as well as normal paraffins from other hydrocarbons, using molecular sieves having a pore diameter of between about 4 and 6 Å. Low-branched paraffins have only one or two tertiary carbons, and preferably are the mono-methyl paraffins. This type of process uses an adsorbent having a slightly larger pore size than the 5 A zeolite to adsorb mono-methyl as well as normal paraffins, as described in U.S. Pat. No. 4,717,784. Mono-methyl paraffins have higher octane numbers than the corresponding normal paraffins, but generally lower than catalytic reformate or finished gasoline, and usually are present in reformate in greater concentrations than are normal paraffins. Adsorptive separation of mono-methyl paraffins thus increases the octane number of the aromatic-rich raffinate from adsorption, but reduces the yield of raffinate relative to removal of only normal paraffins due to conversion losses when mono-methyl paraffins are recycled to aromatization.

The adsorbent used in the present process preferably is selected from one or more of the aforementioned 5 A or calcium zeolite A; FER, MEL, MFI and MTT (IUPAC Commission on Zeolite Nomenclature); and the non-zeolitic molecular sieves of U.S. Pat. Nos. 4,310,440; 4,440,871; and 4,554,143. Highly preferred adsorbents are 5 A zeolite and FER, and ALPO-5 of U.S. Pat. No. 4,310,440. Especially preferred are isotypic sieves of the AFI structure having large pores (>7 Å), especially AIPO-5 and SAPO-5, in which selective adsorption is not shape selective.

In adsorption using non-shape-selective adsorbents of the AFI structure, higher-octane components such as dimethyl- and trimethylparaffins, naphthenes and aromatics are adsorbed from reformates as extract while most of the normal paraffins and monomethylparaffins are rejected in the raffinate (isopentane also concentrates in the raffinate, but the reformate is expected to contain only a small proportion of pentanes). This contrasts with the adsorption of normal paraffins and, optionally, monomethylparaffins in shape-selective adsorbents as described hereinabove. Following adsorption of high-octane components in an AFI adsorbent, a desorbent is employed to displace the paraffinic raffinate from the void spaces of the adsorbent. Desorption of the extract, which is rich in cyclics and multi-branched paraffins, then is effected with the desorbent.

The adsorbent may be employed in the process in the form of a fixed bed in which adsorption of the extract from the reformate feed is effected followed by displacement of the raffinate and desorption of the paraffins using a desorbent fluid. Preferably a higher-efficiency countercurrent or simulated moving-bed adsorption system is used, as described, inter alia, in U.S. Pat. Nos. 2,985,589 and 3,274,099. In the latter system, a rotary disc valve as described in U.S. Pat. Nos. 3,040,777 and 3,422,848 is preferably used to distribute input and output streams to and from the adsorption bed. The desorbent fluid usually is separated from the paraffins and raffinate and returned to the separation zone. Liquid-phase operations are preferred due to lower required temperatures and resulting improved selectivities. Adsorption conditions also comprise conditions suitable for desorption to recover a low-octane paraffinic fraction and include a temperature range of from about 20° to 250° C. and pressure within the range of 100 kPa to about 3 MPa.

The recycle stream from separation which comprises normal and singly branched paraffins is processed over an aromatization catalyst in the aromatization zone to enrich its aromatics content. Dehydrocyclization conditions used in the aromatization zone of the present invention include a pressure of from about 100 kPa to 6 MPa (absolute), with the preferred range being from about 100 kPa to 2 MPa and a pressure of below 1 MPa being especially preferred. Free hydrogen is supplied to the aromatization zone in an amount sufficient to correspond to a ratio of from about 0.1 to 10 moles of hydrogen per mole of hydrocarbon feedstock. By "free hydrogen" is meant molecular $H_2$, not combined in hydrocarbons or other compounds. The volume of the contained aromatization catalyst corresponds to a liquid hourly space velocity of from about 1 to 40 $hr^{-1}$. The operating temperature, defined as the maximum temperature of the combined hydrocarbon feedstock, free hydrogen, and any components accompanying the free hydrogen, generally is in the range of 260° to 560° C. This temperature is selected to achieve optimum overall results from the combination of the first and reforming zones with respect to yields of aromatics in the product, when chemical aromatics production is the objective, or properties such as octane number when gasoline is the objective. Hydrocarbon types in the feed stock also influence temperature selection, as the aromatization catalyst is particularly effective for dehydrocyclization of light paraffins. Naphthenes generally are dehydrogenated to a large extent in the reforming reactor with a concomitant decline in temperature across the catalyst bed due to the endothermic heat of reaction. Initial reaction temperature generally is slowly increased during each period of operation to compensate for the inevitable catalyst deactivation. The temperature to the reactors of the first and reforming zones optimally are staggered, i.e., differ between reactors, in order to achieve product objectives with respect to such variables as ratios of the different aromatics and concentration of nonaromatics. Usually the maximum temperature in the aromatization zone is lower than that in the reforming zone, but the temperature in the aromatization zone may be higher depending on catalyst condition and product objectives.

The aromatization zone comprises one or more reactors containing the aromatization catalyst. If the zone comprises only a single reactor or reactors in parallel, the aromatics-enriched product stream comprises a substantial amount of nonaromatics which subsequently are separated and returned to the aromatization zone. Since a major reaction occurring in the aromatization zone is the dehydrocyclization of paraffins to aromatics along with the usual dehydrogenation of naphthenes, the resulting endothermic heat of reaction may cool the reactants below the temperature at which reforming takes place before sufficient dehydrocyclization has occurred. This zone therefore may comprise two or more reactors with interheating between reactors to raise the temperature and maintain dehydrocyclization conditions to achieve a higher concentration of aromatics in the aromatics-enriched stream than would be obtained in a single reactor.

The aromatization zone produces an aromatics-enriched stream, with the aromatics content of the $C_5$+ portion increased by at least 5 mass % relative to the aromatics content of the hydrocarbon feedstock. The composition of the aromatics will depend principally on the feedstock composition and operating conditions, and generally will consist principally of $C_6$–$C_{12}$ aromatics. Benzene, toluene and $C_8$ aromatics will be the primary aromatics produced from the preferred light naphtha and raffinate feedstocks.

The aromatization catalyst contains a non-acidic L-zeolite, an alkali-metal component and a platinum-group metal component. It is essential that the L-zeolite be non-acidic, as acidity in the zeolite lowers the selectivity to aromatics of the finished catalyst. In order to be "non-acidic," the zeolite has substantially all of its cationic exchange sites occupied by nonhydrogen species. Preferably the cations occupying the exchangeable cation sites will comprise one or more of the alkali metals, although other cationic species may be present. An especially preferred nonacidic L-zeolite is potassium-form L-zeolite.

Generally the L-zeolite is composited with a binder in order to provide a convenient form for use in the catalyst of the present invention. The art teaches that any refractory inorganic oxide binder as described hereinabove is suitable. One or more of silica, alumina or magnesia are preferred binder materials of the present invention. Amorphous silica is especially preferred, and excellent results are obtained when using a synthetic white silica powder precipitated as ultra-fine spherical particles from a water solution. The silica binder preferably is nonacidic, contains less than 0.3 mass % sulfate salts, and has a BET surface area of from about 120 to 160 $m^2/g$.

The L-zeolite and binder may be composited to form the desired catalyst shape by any method known in the art. For example, potassium-form L-zeolite and amorphous silica may be commingled as a uniform powder blend prior to introduction of a peptizing agent. An aqueous solution comprising sodium hydroxide is added to form an extrudable dough. The dough preferably will have a moisture content of from 30 to 50 mass % in order to form extrudates having acceptable integrity to withstand direct calcination. The resulting dough is extruded through a suitably shaped and sized die to form extrudate particles, which are dried and calcined by known methods. Alternatively, spherical particles may be formed by methods described hereinabove for the aromatization catalyst.

An alkali-metal component is an essential constituent of the aromatization catalyst. One or more of the alkali metals, including lithium, sodium, potassium, rubidium, cesium and mixtures thereof, may be used, with potassium being preferred. The alkali metal optimally will occupy essentially all of the cationic exchangeable sites of the non-acidic L-zeolite. Surface-deposited alkali metal also may be present as described in U.S. Pat. No. 4,619,906, incorporated herein in by reference thereto.

A catalytically effective amount of a platinum-group metal component is an essential feature of the aromatization catalyst, with a platinum component being preferred. The platinum-group metal component may be incorporated in the catalyst in any suitable manner such as but not limited to coprecipitation, ion exchange or impregnation with a soluble, decomposable compound of the metal. The platinum-group metal may exist within the catalyst as a compound such as the oxide, sulfide, halide, or oxyhalide, in chemical combination with one or more other ingredients of the catalytic composite, or as an elemental metal. Best results are obtained when substantially all of the metal exists in the catalytic composite in a reduced state. The preferred platinum component generally comprises from about 0.01 to 5 mass % of the catalytic composite, preferably 0.05 to 2 mass %, calculated on an elemental basis.

It is within the scope of the present invention that the catalyst may contain other metal components known to modify the effect of the preferred platinum component. Such metal modifiers may include Group IVA(IUPAC 14) metals, other Group VIII(IUPAC 8-10) metals, rhenium, indium, gallium, zinc, uranium, dysprosium, thallium and mixtures thereof. Catalytically effective amounts of such metal modifiers may be incorporated into the catalyst by any means known in the art.

The final aromatization catalyst generally will be dried at a temperature of from about 100° to 320° C. for about 0.5 to 24 hours, followed by oxidation at a temperature of about 300° to 550° C. (preferably about 350° C.) in an air atmosphere for 0.5 to 10 hours. Preferably the oxidized catalyst is subjected to a substantially water-free reduction step at a temperature of about 300° to 550° C. (preferably about 350° C.) for 0.5 to 10 hours or more. The duration of the reduction step should be only as long as necessary to reduce the platinum, in order to avoid pre-deactivation of the catalyst, and may be performed in-situ as part of the plant startup if a dry atmosphere is maintained. Further details of the preparation and activation of embodiments of the aromatization catalyst are disclosed, e.g., in U.S. Pat. Nos. 4,619,906 (Lambert et al) and 4,822,762 (Ellig et al.), which are incorporated into this specification by reference thereto.

The feed to the aromatization zone may contact the respective catalyst in each of the respective reactors in either upflow, downflow, or radial-flow mode. Since the present reforming process operates at relatively low pressure, the low pressure drop in a radial-flow reactor favors the radial-flow mode.

The aromatization catalyst is contained in a fixed-bed reactor or in a moving-bed reactor whereby catalyst may be continuously withdrawn and added. These alternatives are associated with catalyst-regeneration options known to those of ordinary skill in the art, such as: (1) a semiregenerative unit containing fixed-bed reactors maintains operating severity by increasing temperature, eventually shutting the unit down for catalyst regeneration and reactivation; (2) a swing-reactor unit, in which individual fixed-bed reactors are serially isolated by manifolding arrangements as the catalyst become deactivated and the catalyst in the isolated reactor is regenerated and reactivated while the other reactors remain on-stream; (3) continuous regeneration of catalyst withdrawn from a moving-bed reactor, with reactivation and substitution of the reactivated catalyst, permitting higher operating severity by maintaining high catalyst activity through regeneration cycles of a few days; or: (4) a hybrid system with semiregenerative and continuous-regeneration provisions in the same unit. The preferred embodiment of the present invention is a fixed-bed reactor in a semiregenerative aromatization zone.

Since the aromatization zone generally is added to an existing reforming zone, the aromatization catalyst usually comprises from about 5% to about 50% of the total reforming catalyst. The actual proportion depends on such factors as the nature of the feedstock, the severity of operation, proportion of recycle and product objectives.

EXAMPLES

The following examples are presented to demonstrate the present invention and to illustrate certain specific embodiments thereof. These examples should not be construed to limit the scope of the invention as set forth in the claims. There are many possible other variations, as those of ordinary skill in the art will recognize, which are within the spirit of the invention.

Three parameters are especially useful in evaluating reforming process and catalyst performance, particularly in evaluating catalysts for dehydrocyclization of paraffins. "Activity" is a measure of the catalyst's ability to convert reactants at a specified set of reaction conditions. "Selectivity" is an indication of the catalyst's ability to produce a high yield of the desired product. "Stability" is a measure of the catalyst's ability to maintain its activity and selectivity over time.

The examples present material balances when processing a raffinate feedstock, derived by extraction of aromatics from a reformate, comprising principally $C_6$–$C_8$ hydrocarbons. The raffinate feedstock had the following characteristics:

| | | |
|---|---|---|
| Sp. gr. | | 0.689 |
| ASTM D-86, °C.: | IBP | 67 |
| | 50% | 82 |
| | EP | 118 |
| Mass % | Paraffins | 87.5 |
| | Olefins | 2.0 |
| | Naphthenes | 7.1 |
| | Aromatics | 3.4 |

Example I

A pilot plant test was carried out at about 500 kPa and 55 mass % nonaromatics conversion to achieve a $C_5$+ product Research clear octane number of about 86, using a catalyst containing platinum on bound L-zeolite. The catalyst contained 0.82 mass % platinum on a base of potassium-form L-zeolite composition with silica. The yield structure was as follows in mass %:

| | Feed | Products |
|---|---|---|
| $H_2$ | — | 3.0 |
| $C_1$–$C_4$ | — | 6.5 |
| $iC_5$ | — | 1.0 |
| $nC_5$ | 0.2 | 2.2 |
| $C_6$+ n-paraffins | 23.1 | 7.9 |
| Monomethyl paraffins | 44.4 | 24.0 |
| Dimethyl paraffins | 10.3 | 7.5 |
| Trimethyl+ paraffins | 9.5 | 1.7 |
| Olefins | 2.0 | 0.5 |
| Naphthenes | 7.1 | 2.2 |
| Aromatics | 3.4 | 43.5 |
| Totals | 100.0 | 100.0 |

Example II

Yields were calculated for a process of the present invention, with separation from reformate and recycle of paraffins to an aromatization reactor at the same conditions and with the same catalyst as used in Example I. The paraffin recycle comprises normal and monomethyl paraffins, such as would be obtained as an extract of an FER-type molecular-sieve separation or a raffinate of an AFI-type molecular sieve separation. The results are as follows in mass %:

| | Feed | Recycle | Net Gas | Extract |
|---|---|---|---|---|
| $H_2$ | — | | 4.4 | |
| $C_1$–$C_4$ | — | | 9.5 | |
| $iC_5$ | — | 0.5 | 1.1 | |
| $nC_5$ | 0.2 | 1.1 | 3.1 | |
| $C_6$+ n-par. | 23.1 | 12.0 | | |
| Monomethyl paraffins | 44.4 | 52.2 | | |
| Dimethyl paraffins | 10.3 | — | | 7.5 |
| Trimethyl+ paraffins | 9.5 | — | | 1.7 |
| Olefins | 2.0 | — | | 0.5 |
| Naphthenes | 7.1 | — | | 2.2 |
| Aromatics | 3.4 | — | | 69.7 |
| Total | 100.0 | 65.8 | 18.4 | 81.6 |

The Research clear octane number of the aromatics-enriched stream was calculated to be 106.3, compared to the 86 octane product of Example I. The yield of aromatics relative to the feedstock was increased by about 60%.

Example III

A sample of SAPO-5 adsorbent was prepared for testing by binding with 15 mass % bentonite clay and grinding to a size of 20 to 60 mesh.

A feedstock sample was prepared for determination of selectivity by blending equal volumes respectively of 2,2-dimethylbutane, 2-methylpentane, normal hexane, benzene and toluene.

A dynamic testing apparatus was employed to test various adsorbents with a particular feed mixture and desorbent material to measure the adsorption characteristics of retention, capacity and exchange rate. The apparatus used herein consisted of a helical adsorbent chamber of approximately 70 cc volume having inlet and outlet portions at opposite ends of the chamber. The chamber was contained within a temperature control means and, in addition, pressure control equipment was used to operate the chamber at a constant predetermined pressure. Quantitative and qualitative analytical equipment such as refractometers, polarimeters and chromatographs can be attached to the outlet line of the chamber and used to detect qualitatively, or determine quantitatively, one or more components in the effluent stream leaving the adsorbent chamber. A pulse test, performed using this apparatus and the following general procedure, was used to determine data, e.g., selectivity, for various adsorbent systems. The adsorbent was placed in a chamber and filled to equilibrium with a particular desorbent material by passing the desorbent material through the adsorbent chamber. At a convenient time, a pulse of feed containing known concentrations of a tracer and of a particular extract component or of a raffinate component or both, all diluted in desorbent material was injected for a duration of several minutes. Desorbent material flow is resumed, and the tracer and the extract component or the raffinate component (or both) were eluted as in a liquid-solid chromatographic operation. The effluent was analyzed on-stream or alternatively, effluent samples can be collected periodically and later analyzed separately by analytical equipment and traces of the envelopes or corresponding component peaks developed.

From information derived from the text, adsorbent performance was rated in terms of void volume, net retention volume (NRV) for an extract or a raffinate component, the rate of desorption of an extract component from the adsorbent and selectivity. The net retention volume of an extract or a raffinate component may be characterized by the distance between the center of the peak envelope of the extract or raffinate component and the center of the peak envelope of the tracer component (void volume) or some other known reference point. Gross retention volume (GRV) is the distance between the center of a peak envelope and the zero abscissa and measured as total ml. of desorbent material pumped during this interval. NRV is also the difference between the respective GRVs and the GRV of the tracer. It is expressed in terms of the volume in cubic centimeters of desorbent material pumped during this time interval represented by the distance between the peak envelopes. The rate of exchange or desorption rate of an extract component with the desorbent material can generally be characterized by the width of the peak envelopes at half intensity. The narrower the peak width, the faster the desorption rate. Selectivity, β, is calculated as the ratio of the net retention volume of one of the components (reference) to that of each of the other components.

The temperature was 120° C. and the flow rate was 1.42 cc/min, and normal heptane was employed as the desorbent. The results were recorded as follows:

| | GRV | NRV | β |
|---|---|---|---|
| Hexane | 46.5 | 0.0 | * |
| Benzene | 60.7 | 14.2 | 0.54 |
| Toluene | 55.4 | 8.9 | 0.87 |
| 2,2-dimethylbutane | 54.2 | 7.7 | 1.00 |
| 2-methylpentane | 47.5 | 1.0 | 7.7 |

*very high number

Figure 2:
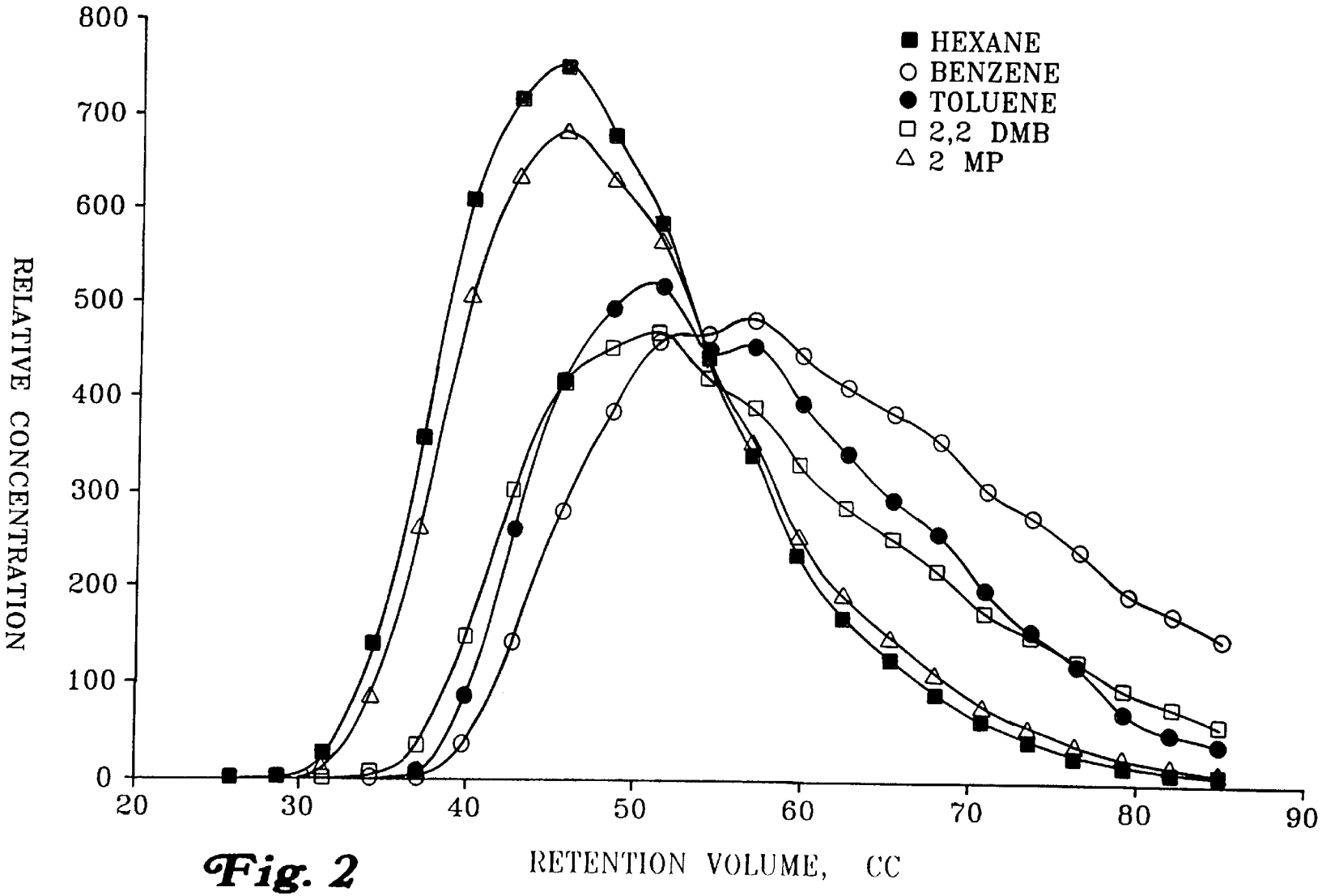
FIG. 2 shows selectivity of adsorption of hydrocarbon types on SAPO-5 adsorbent.

FIG. 2 is a graphic depiction of the results, showing selectivity of adsorption of aromatics and dimethylbutane relative to normal hexane and methylpentane.

We claim:

1. An add-on process for increasing the yield of aromatic product from an existing catalytic reforming unit which upgrades a hydrocarbon feedstock at reforming conditions in a hydrogen circuit with a reforming catalyst to obtain a reformate, the add-on process comprising the steps of:

(a) processing the reformate in combination with an aromatics-enriched stream from step (b) in a separation zone comprising solvent extraction to obtain an aromatic product stream and a recycle stream comprising normal and singly branched heptanes; and, (b) converting the recycle stream in an aromatization zone within the reforming-process hydrogen circuit at dehydrocyclization conditions with a zeolitic aluminosilicate aromatization catalyst to obtain an aromatics-enriched stream which subsequently is processed according to step (a).

2. The process of claim 1 wherein the separation zone of step (a) further comprises adsorptive separation in sequence with solvent extraction.

3. The process of claim 2 wherein the adsorptive separation is effected using a molecular sieve which adsorbs aromatics and multiply branched paraffins from the reformate.

4. The process of claim 3 wherein the molecular sieve is a non-zeolitic molecular sieve.

5. The process of claim 4 wherein the non-zeolitic molecular sieve is selected from the group consisting of AFI-type molecular sieves.

6. The process of claim 4 wherein the non-zeolitic molecular sieve comprises SAPO-5.

7. The process of claim 1 wherein the aromatization catalyst of step (b) comprises a platinum-group metal component and a non-acidic L-zeolite.

8. The process of claim 7 wherein the platinum-group metal component comprises platinum in an amount of from about 0.05 to 2 mass % on an elemental basis.

9. The process of claim 7 wherein the nonacidic L-zeolite comprises potassium-form L-zeolite.

10. The process of claim 7 wherein the aromatization catalyst further comprises a refractory inorganic oxide.

11. The process of claim 7 wherein the aromatization catalyst further comprises an alkali-metal component.

12. The process of claim 11 wherein the alkali-metal component comprises a potassium component.

13. The process of claim 1 wherein the dehydrocyclization conditions of step (b) comprise a pressure of from about 100 kPa to 6 MPa (absolute), a ratio of from about 0.1 to 10 moles of hydrogen per mole of hydrocarbon feedstock, a liquid hourly space velocity of from about 1 to 40 $hr^{-1}$, and an operating temperature of from about 260° to 560° C.

14. The process of claim 1 wherein the reforming catalyst comprises a platinum-group metal component and a non-acidic L-zeolite.

15. The process of claim 1 wherein the reforming catalyst and the aromatization catalyst have substantially the same composition.

16. The process of claim 1 wherein the reforming conditions comprise a pressure of from about 100 kPa to 6 MPa (absolute), a ratio of from about 0.1 to 10 moles of hydrogen per mole of hydrocarbon feedstock, a liquid hourly space velocity of from about 0.2 to 20 $hr^{-1}$, and an operating temperature of from about 400° to 560° C.

17. The process of claim 1 wherein the hydrocarbon feedstock comprises a naphtha feedstock having an initial boiling point of at least about 60° C.

18. An add-on process for increasing the yield of aromatic product from a catalytic reforming unit which upgrades a hydrocarbon feedstock at reforming conditions in a hydrogen circuit with a reforming catalyst to obtain a reformate, the process comprising the steps of:

(a) processing the reformate in combination with an aromatics-enriched stream from step (b) in a separation zone comprising a combination of solvent extraction and adsorptive separation in sequence to obtain an aromatic product stream, a stream of higher-octane paraffins and a recycle stream comprising normal and singly branched heptanes; and, (b) converting the recycle stream in an aromatization zone within the reforming-process hydrogen circuit at dehydrocyclization conditions with a zeolitic aluminosilicate aromatization catalyst to obtain an aromatics-enriched stream which subsequently is processed according to step (a).

19. The process of claim 18 wherein the adsorptive separation is effected using a non-zeolitic molecular sieve consisting essentially of SAPO-5.

20. An add-on process for increasing the yield of aromatic product from an existing catalytic reforming unit which upgrades a hydrocarbon feedstock at reforming conditions in a hydrogen circuit with a reforming catalyst to obtain a reformate, the process comprising the steps of:

(a) processing the reformate in combination with an aromatics-enriched stream from step (b) in a separation zone comprising a combination of solvent extraction and adsorptive separation in sequence to obtain an aromatic product stream, a stream of higher-octane paraffins and a recycle stream comprising normal and singly branched heptanes; and, (b) converting the recycle stream in an aromatization zone within the reforming-process hydrogen circuit at dehydrocyclization conditions, comprising a pressure of from about 100 kPa to 6 MPa (absolute), a ratio of from about 0.1 to 10 moles of hydrogen per mole of hydrocarbon feedstock, a liquid hourly space velocity of from about 1 to 40 $hr^{-1}$, and an operating temperature of from about 260° to 560° C., with an aromatization catalyst comprising a platinum-group metal component and a non-acidic L-zeolite to obtain an aromatics-enriched stream which subsequently is processed according to step (a).

* * * * *